US005901850A

United States Patent [19]

Jones et al.

[11] Patent Number: 5,901,850

[45] Date of Patent: May 11, 1999

[54] INFLATABLE PACKAGING ASSEMBLY

[75] Inventors: Robert R. Jones, Westland, Mich.; John LaRoi, Jr., Libertyville, Ill.

[73] Assignee: Impackt, L.L.C., Westland, Mich.

[21] Appl. No.: 08/866,615

[22] Filed: May 30, 1997

Related U.S. Application Data

[XX .

[60] Provisional application No. 60/027,879, Oct. 4, 1996.

[51] Int. Cl.[6] ..... B65D 81/02

[52] U.S. Cl. ..... 206/522; 206/591; 383/3

[58] Field of Search ..... 206/522, 525, 206/585, 591; 383/3; 410/47, 49, 125, 119

[56] References Cited

U.S. PATENT DOCUMENTS

| | | | |
|---|---|---|---|
| 2,804,257 | 8/1957 | Hasler et al. . | |
| 3,366,231 | 1/1968 | Trakas . | |
| 3,552,466 | 1/1971 | Fairchilds . | |
| 3,889,743 | 6/1975 | Presnick . | |
| 4,091,852 | 5/1978 | Jordan et al. . | |
| 4,793,123 | 12/1988 | Pharo . | |
| 4,872,558 | 10/1989 | Pharo . | |
| 4,874,093 | 10/1989 | Pharo . | |
| 4,905,835 | 3/1990 | Pivert et al. | 206/522 |
| 4,918,904 | 4/1990 | Pharo . | |
| 5,042,663 | 8/1991 | Heinrich | 410/119 |
| 5,254,074 | 10/1993 | Landers et al. . | |
| 5,272,856 | 12/1993 | Pharo . | |
| 5,339,602 | 8/1994 | Landers et al. . | |
| 5,348,157 | 9/1994 | Pozzo . | |
| 5,451,179 | 9/1995 | LaRoi, Jr. et al. | 410/119 |
| 5,454,642 | 10/1995 | De Luca | 206/522 |
| 5,480,029 | 1/1996 | Batsford | 206/522 |

FOREIGN PATENT DOCUMENTS

| | | | |
|---|---|---|---|
| 2385606 | 12/1978 | France | 206/522 |
| WO8500151 | 1/1985 | WIPO . | |
| WO9418091 | 8/1994 | WIPO . | |
| WO9622926 | 8/1996 | WIPO . | |

*Primary Examiner*—David T. Fidel
*Attorney, Agent, or Firm*—Howard & Howard

[57] ABSTRACT

An inflatable packaging assembly (10) comprising a container (12) and a flexible bag (28). The container (12) has a base (14) and a number of upstanding walls (16) extending from the base (14) to a container opening (18) for receiving and storing a package item (20). One of the upstanding walls (16) includes an aperture (26) passing through the wall (16). The bag (28) includes first (30) and second (32) bag panels having peripheral edges (34) sealed together to define an inflatable chamber. A bag opening (36) extends through a portion of the sealed edges (34) for receiving a fluid medium to inflate the bag (28). A filling valve (38) extends through the bag opening (36) and into the inflatable chamber. The filling valve (38) includes a flexible sealing port (40) and a filling tube (46). The filling tube (46) has a first end (48) secured to the sealing port (40) and a semi-rigid second end (50) extending out from the bag opening (36). The semi-rigid second end (50) is inserted through the aperture (26) in the container (12) and removably secured to one of the walls (16), whereby the bag (28) is positioned in the container (12) to overlay the packaging item (20) and the bag (28) is inflatable by the fluid medium received through the filling tube (46) in the aperture (26) of the upstanding wall (16).

16 Claims, 12 Drawing Sheets

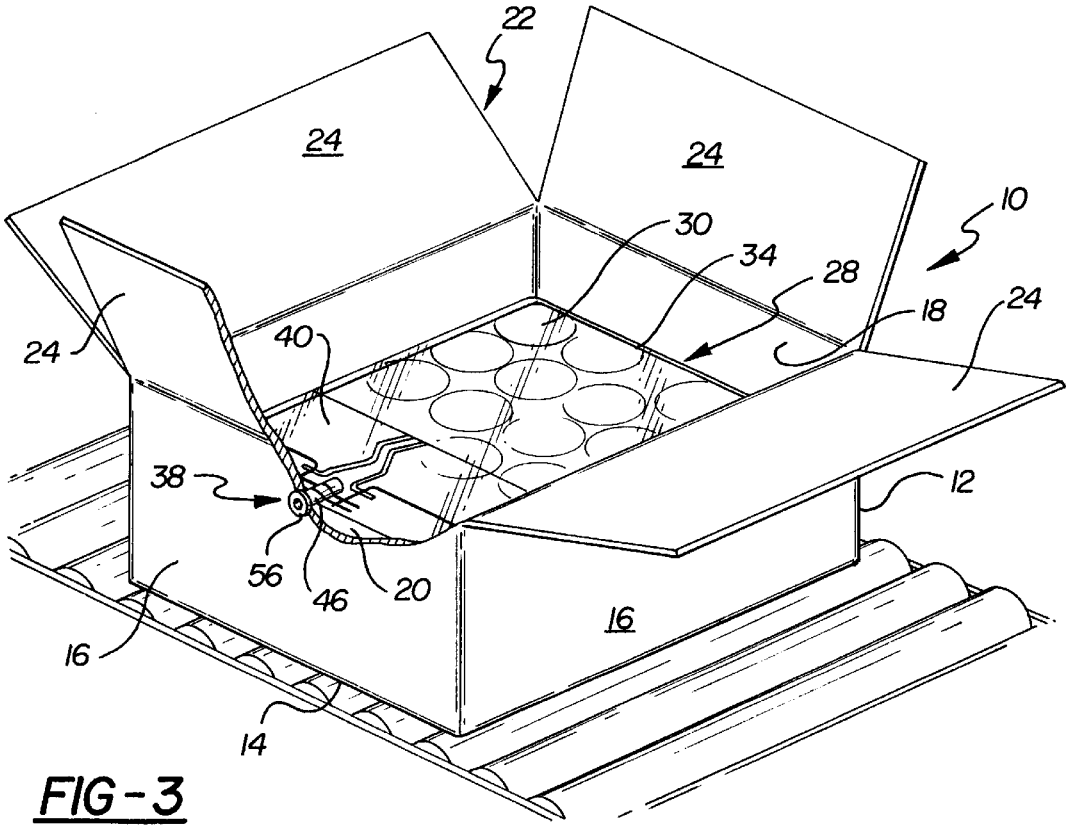
FIG-3
FIG-4
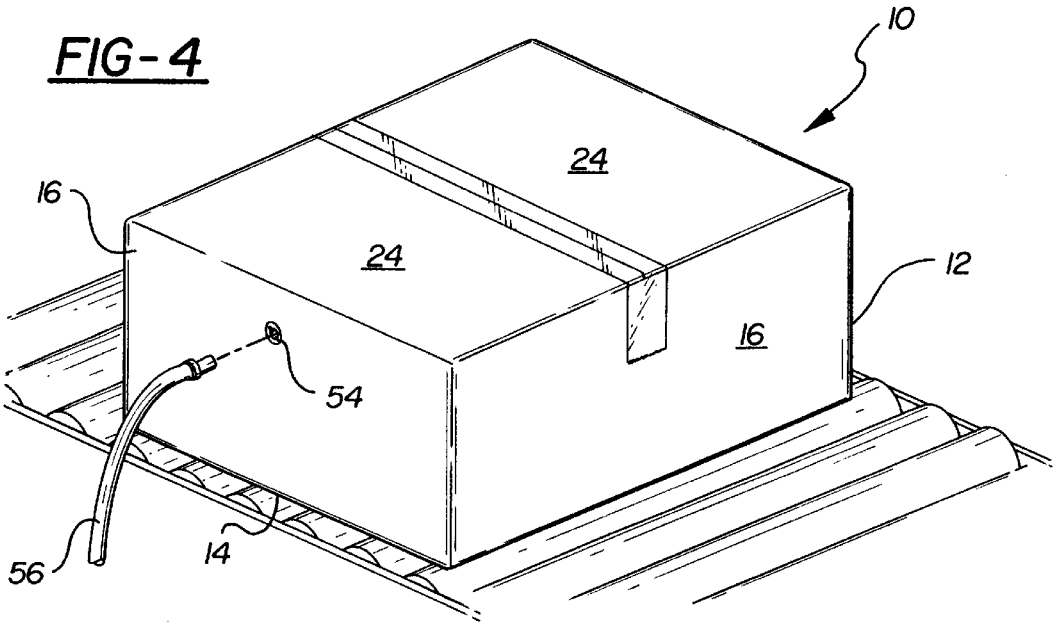

12
30
40
41
44
16
55
37
28
26
43
39
38
52
34
55
12
62

16
62
55
38
55
30
56
26
40
52
52
32
55
55
62

40
41
30
28
44
37
45
64
14
46
53
54
38
39
43
34
26
14
16

16
54
46
64
53

26

40
41
30
28
16
44
37
16
66
34
54
46
53
68
38
45
43
16
39

INFLATABLE PACKAGING ASSEMBLY

RELATED APPLICATION

This application claims priority to and all of the benefits of co-pending U.S. provisional patent application Ser. No. 60/027,879 which was filed on Oct. 4, 1996 and is entitled "Inflatable Packaging Assembly."

TECHNICAL FIELD

The subject invention relates generally to void fill packaging devices and more specifically to an inflatable bag for occupying the void space in a packaging container.

BACKGROUND OF THE INVENTION

By way of background, void filling devices have been used in the packaging industry for protecting a packaging item within a container for a number of years. Typical examples of void filling devices can include preformed Styrofoam blocks, small particles of different shapes and sizes (commonly referred to as styrene loose-fill), plastic sheets with sealed plastic air pockets, injected liquid foam, corrugated cardboard inserts and even popcorn. Many of these void filling devices adequately protect the item; however, they may be bulky to store, expensive, non-reusable, and/or a nuisance to dispose of.

U.S. Pat. No. 5,339,602 to Landers et al. discloses an inflatable bag for use as a void filling device within a container. The bag includes an interior chamber with a flexible valve extending outwardly from the chamber. The bag is placed over a packaging item located within the container. A number of flaps extending from the container are folded over the bag wherein the flexible valve extends out of the container through a gap between the flaps. The container is then sealed and the bag is inflated, which compresses any void space between the packaging item and the container. During the inflation of the bag the flexible valve remains outside the container. The flexibility and placement of the valve creates a number of problems when filling the bag, i.e., an increase in manual labor, the possibility of a puncture, etc. Further, positioning the flexible valve while closing the box creates additional manufacturing problems such as increased manual labor, slower conveyor speeds, and limited surface space for sealing the box. After inflation of the bag, the flexible valve remains outside the container where it may be ruptured or torn. The flexible valve can also be ruptured or torn if pushed through the gap back into the container.

U.S. Pat. No. 4,793,123 to Pharo discloses an inflatable bag that wraps around a packaging item and is then placed within a container with a flexible valve extending out through a slot-like opening in the container. The container is then sealed and the bag is inflated, which compresses any void space between the packaging item and the container. The inflatable bag design disclosed in the Pharo '123 patent has a number of deficiencies that are similar to the deficiencies of the inflatable bag disclosed above in the Landers et al. '602 patent. Specifically, during the inflation of the bag the flexible valve remains outside the container wherein the flexibility and placement of the valve creates a number of problems when filling the bag. After inflation, the flexible valve remains outside the container where it may be ruptured or torn or the valve is pushed through the opening back into the container. In addition, the opening should be sealed to prevent any intrusion of water and/or dirt. The extra steps of pushing the valve back through the opening and sealing the opening increases labor costs and manufacturing time.

SUMMARY OF THE INVENTION AND ADVANTAGES

An inflatable packaging assembly comprising a container having a base and a plurality of upstanding walls extending from the base to a container opening for receiving and storing a package item therein. An aperture passes through a portion of the container. A flexible bag defines an inflatable chamber having a bag opening for receiving a fluid medium to inflate the bag. A filling valve has a first portion fixedly secured to the bag opening and in fluid communication with the inflatable chamber of the bag and has a second portion inserted through the aperture in the container. The bag is positioned in the container adjacent the packaging item and inflatable by the fluid medium received through the filling valve in the aperture of the upstanding wall. The assembly is characterized by the filling valve including retaining means for securing the filling valve within the aperture.

The flexible bag of the subject invention includes first and second bag panels having peripheral edges sealed together to define the inflatable chamber therebetween. The bag opening extends through a portion of the sealed edges for receiving the fluid medium to inflate the bag. A flexible sealing port is secured to the peripheral edges adjacent the bag opening and extends into the inflatable chamber. A semi-rigid filling tube has a first end fixedly secured to the sealing port and a second end extending outwardly from the bag opening of said inflatable chamber. The bag is characterized by the retaining means for retaining the filling tube in the aperture in the container, whereby the bag is positioned in the container adjacent the packaging item and the bag is inflatable by the fluid medium received through the filling valve via the aperture.

The method of manufacturing the flexible bag fabricated from the first and second bag panels, the flexible sealing port having two flexible sheets, and the semi-rigid filling tube comprises the steps of; adhering the first and second bag panels and the two flexible sheets of the flexible sealing port together to form the peripheral edge and create the inflatable chamber between the first and second bag panels; adhering the two flexible sheets of the flexible sealing port together along a pair of seams to form a fluid passageway extending into the inflatable chamber; adhering the first bag panel to one of the flexible sheets of the flexible sealing port along a first port seal and adhering the second bag panel to the other flexible sheet of the flexible sealing port along a second port seal to form the bag opening in close proximity to the fluid passageway; inserting the semi-rigid filling tube within the bag opening to interconnect the bag opening with the fluid passageway and the inflatable chamber; and adhering the first and second bag panels and the two flexible sheets of the flexible sealing port to the semi-rigid filling tube along a tube seal to ensure that any fluid passing into the inflatable chamber passes through the filling tube and the fluid passageway.

Accordingly the subject invention overcomes the deficiencies of the prior art by providing a filling valve that is easily installed within a container and is secured to the container during and after the inflation of the bag. In addition, the closing and taping of the container does not disturb the filling valve or the flexible bag.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a partially cross-sectional perspective view of the subject invention secured to the open packaging container;

FIG. 4 is a perspective view of a closed packaging container utilizing the subject invention;

DETAILED DESCRIPTION OF THE PREFERRED EMBODIMENT

Figure 1:
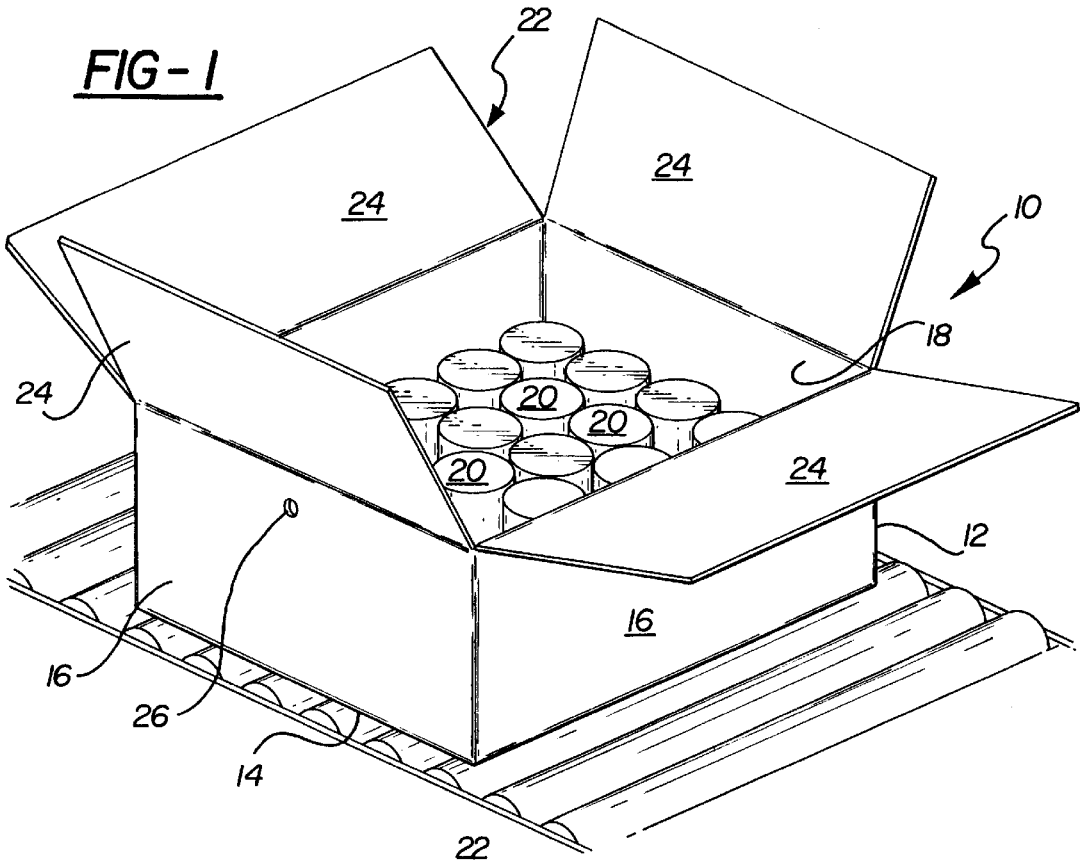
FIG. 1 is a perspective view of an open packaging container.

Referring to the Figures, wherein like numeral indicate like or corresponding parts throughout the several views, an inflatable packaging assembly is generally shown at 10. The inflatable packaging assembly 10 includes a container 12 having a base 14 and a plurality of upstanding walls 16 extending from the base 14 to a container opening 18 for receiving and storing at least one packaging item 20 therein. As shown in the Figures, the container 12 is a rectangular corrugated cardboard box having a rectangular opening. However, the container 12 may be of any shape, size, or configuration or made of any suitable material without deviating from the scope of the subject invention. Further, the packaging item 20 may be any product or object that is placed within the container 12 for the purposes of shipping or securely storing the item 20 therein.

A covering means, generally depicted at 22, covers the container opening 18 and closes the container 12. Specifically, the covering means 22 comprises a plurality of foldable flaps 24 extending from the upstanding walls 16 of the container 12 for folding over the container opening 18 to close the container 12. The flaps 24 are also rectangular and completely cover the container opening 18 in the container 12. As can be appreciated, the flaps 24 can be of any shape, size, or configuration in order to correspond with the shape, size, or configuration of the container 12. In fact, the covering means 22 could be any number of devices, such as a cover or lid that is taped or otherwise affixed to the walls, so long as the packaging item 20 is sufficiently retained within the container 12.

Figure 2:
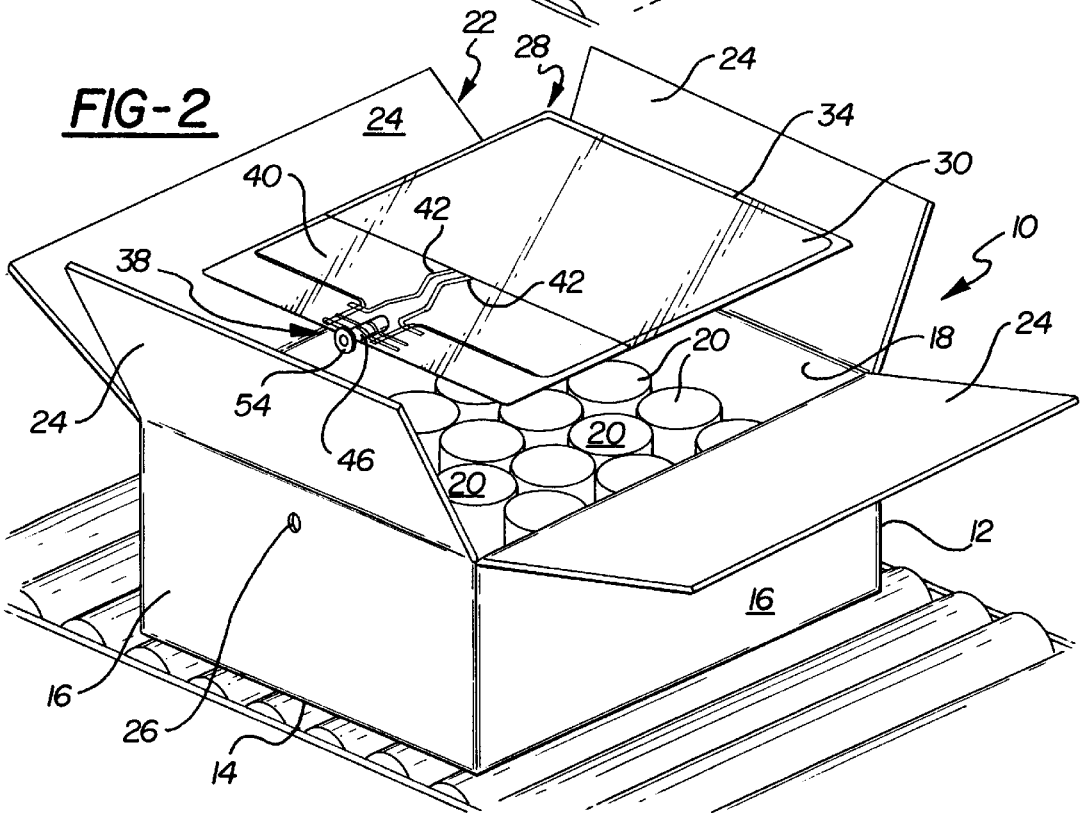
FIG. 2 is a perspective view of the subject invention in exploded relationship to the open packaging container.

As best shown in FIGS. 1 and 2, an aperture 26 passes through a portion of the container 12. More specifically, in the preferred embodiment, the aperture 26 passes through one of the upstanding walls 16 wherein the aperture 26 is located near the intersection of the upstanding wall 16 and a corresponding flap 24 and spaced below and adjacent to the container opening 18. As appreciated by those skilled in the art, the aperture 26 could be located anywhere within the upstanding wall 16 or even in the flap 24 or the base 14 if so desired.

Figure 5:
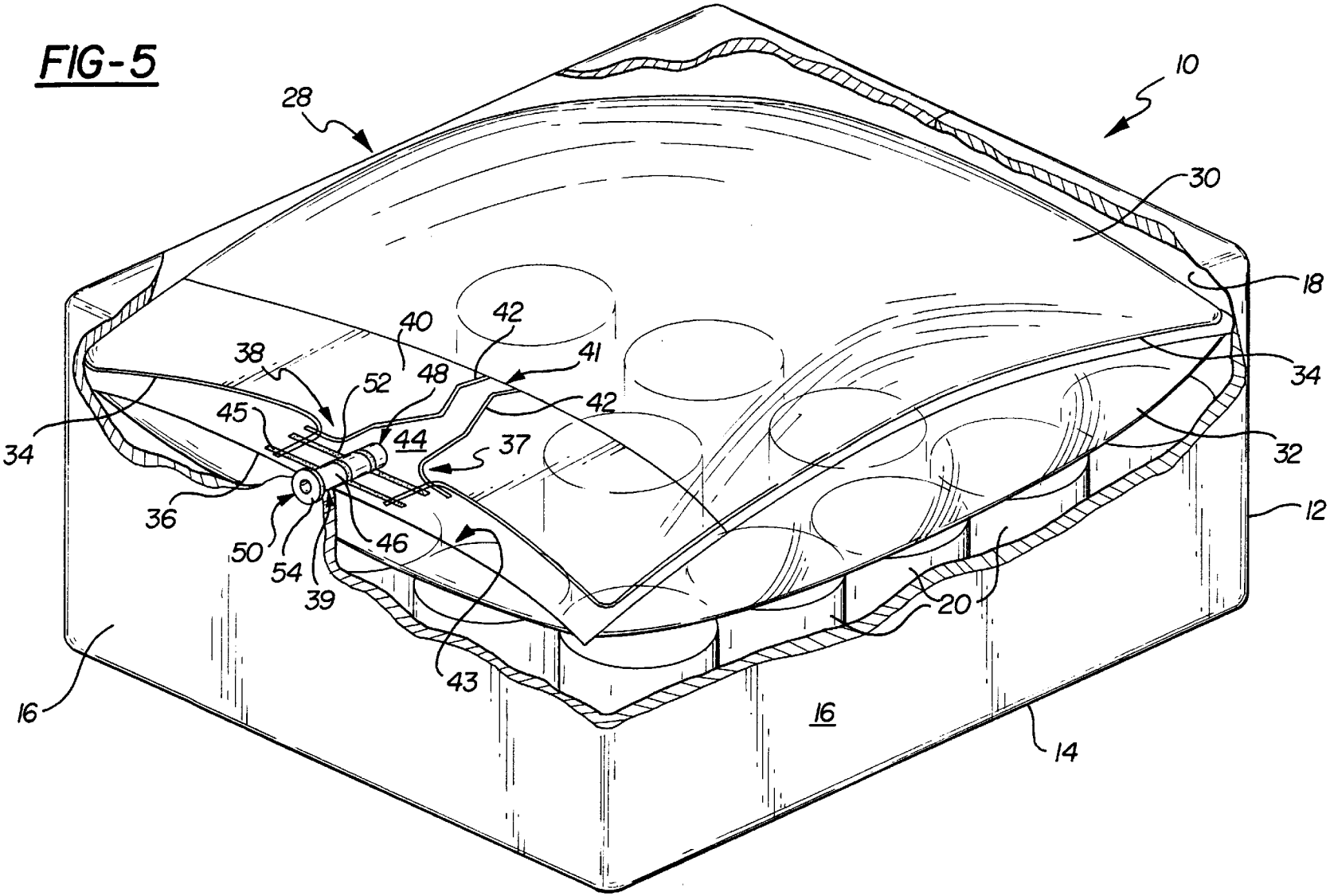
FIG. 5 is a partially cross-sectional perspective view of the subject invention secured to the closed packaging container.

The inflatable packaging assembly 10 also includes a flexible bag, generally depicted at 28, for protecting and filling void space about the packaging item 20 stored in the container 12. The flexible bag 28 of the preferred embodiment is shown in FIGS. 2, 3, 5, 6, and 7. As best shown in FIG. 5, the bag 28 includes first 30 and second 32 bag panels having peripheral edges 34 sealed together to define an inflatable chamber therebetween. A bag opening 36 extends through a portion of the sealed edges 34 for receiving a fluid medium to inflate the bag 28. The bag 28 shown in the Figures of the preferred embodiment has a rectangular shape that corresponds with the rectangular shape of the container 12. As one can appreciate, the bag 28 could be formed of any shape with any number of panels so long as the bag 28 adequately fills the void space within the container 12 to assist in securing and protecting the packaging item 20.

A filling valve, generally depicted at 38, has a first portion 37 fixedly secured to the bag opening 36 and in fluid communication with the inflatable chamber of the bag 28. A second portion 39 of the filling valve 38 is inserted through the aperture 26 in the container 12. The filling valve 38 may be of any suitable design or configuration so long as the fluid medium is capable of entering and being retained within the inflatable chamber of the bag 28. A number of designs for the filling valve 38, including the preferred embodiment, are discussed hereinbelow.

Figure 6:
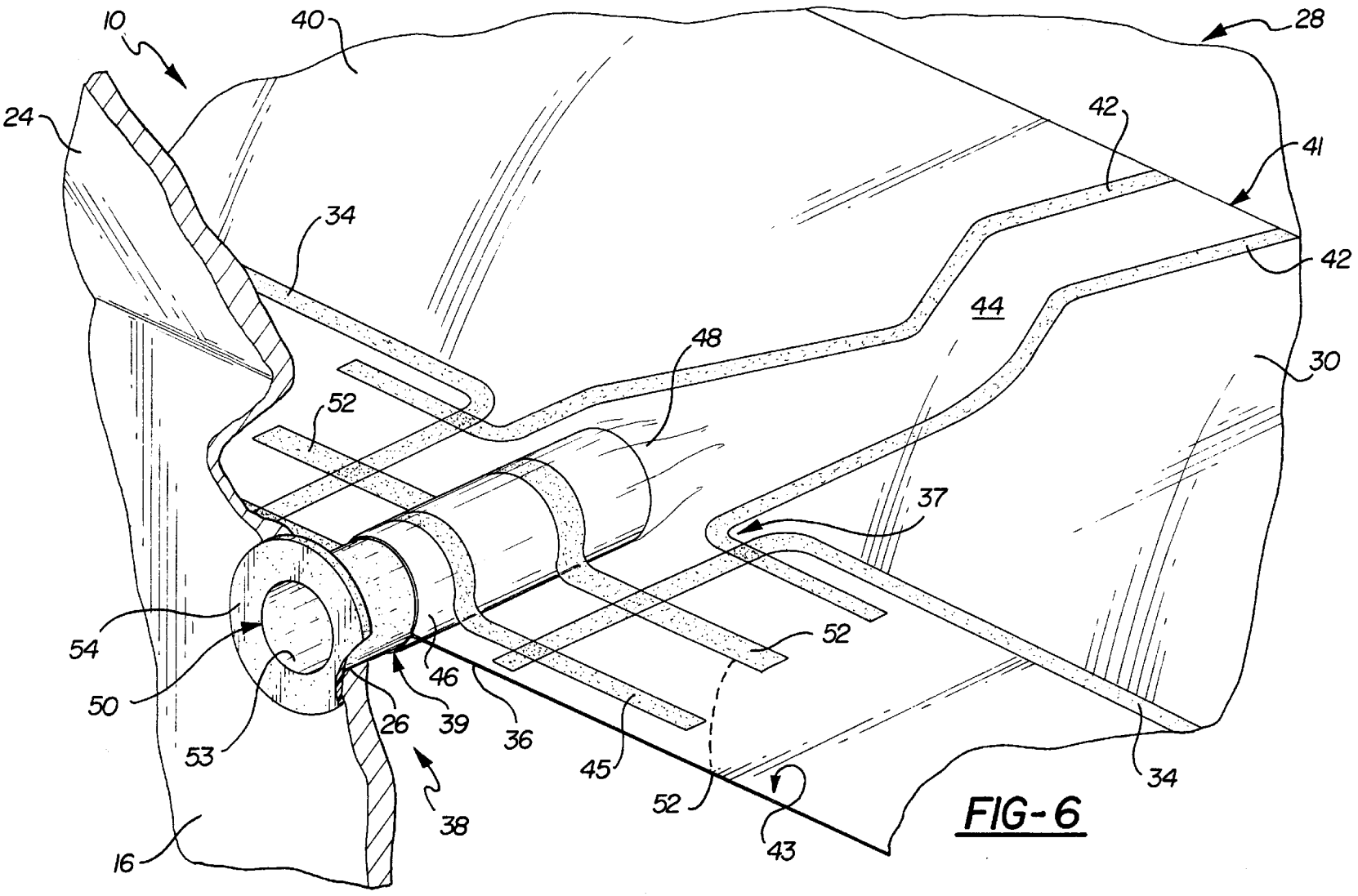
FIG. 6 is an enlarged fragmentary view of the subject invention secured to the closed packaging container.
Figure 7:
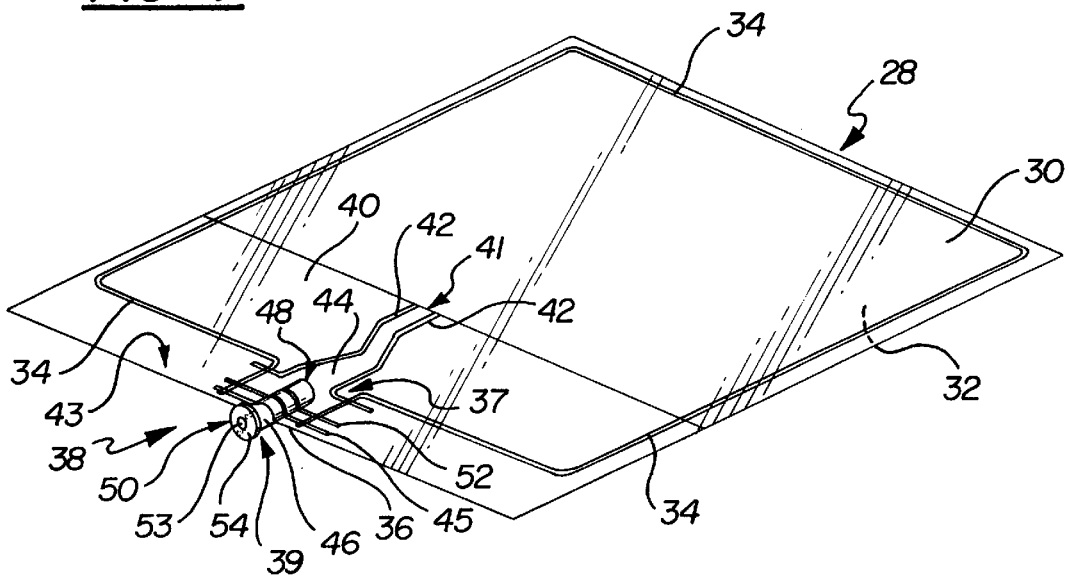
FIG. 7 is a perspective view of the subject invention.

In the preferred embodiment and shown best in FIGS. 5, 6, and 7, the first portion 37 of the filling valve 38 is a flexible sealing port 40 having a first end 41 extending into and in fluid communication with the inflatable chamber. A second end 43, of the sealing port 40, is secured to the peripheral edges 34 adjacent the bag opening 36. Specifically, the sealing port 40 comprises two flexible sheets that extend the entire width of the bag 28 and are adhered together by a seam 42. The seam 42 extends beyond the peripheral edges 34 and defines a fluid passageway 44 extending into the chamber of the bag 28. The seam 42 has a S-shaped or curved figure such that the sealing port 40 automatically seals the inflatable chamber by closing fluid passageway 44 in response to a predetermined pressure within the chamber. As known to those skilled in the art, the sealing port 40 and the seam 42 can be of any design without deviating from the scope of the subject invention so long as the chamber can be adequately sealed.

A first port seal 52 adheres the first bag panel 30 to one of the flexible sheets of said sealing port 40 and a second port seal 52 adheres the second bag panel 32 to the other flexible sheet of the sealing port 40. The first and second port seals 52 extend along their respective bag panels 30, 32 and intersect the peripheral edges 34. Specifically, in the preferred embodiment, the first and second port seals 52 are formed as straight lines that extend substantially perpendicular to the seams 42 and fluid passageway 44. As appreciated by those skilled in the art the first and second port seals 52 can be of any configuration so long as the two flexible sheets of the sealing port 40 are adequately secured to their respective bag panel 30, 32 and the first and second port seals 52 intersect a portion of the peripheral edges 34 of the bag 28.

Also in the preferred embodiment, the second portion 39 of the filling valve 38 is a semi-rigid filling tube 46 having a first end 48 fixedly secured to the second end 43 of the sealing port 40 and at least partially extending into the bag opening 36. More specifically, a tube seal 45 secures the first end 48 of the filling tube 46 to the second end 43 of the sealing port 40. The tube seal 45 also secures the filling tube 46 to the first 30 and second 32 bag panels. The tube seal 45 extends around the filling tube 46, along the bag opening 36, and crosses over the peripheral edges 34. Hence, the tube seal 45 also adheres the first 30 and second 32 bag panels and the two flexible sheets of the sealing port 40 together. The fluid passageway 44 extends between the first end 48 of the filling tube 46 and the first end 41 of the sealing port 40. Hence, the first end 48 of the filling tube 46 is in fluid communication with the inflatable chamber of the bag 28. The sealing port 40 extends into the inflatable chamber of the bag 28 and automatically seals the filling tube 46 in response to a predetermined pressure within the chamber. More specifically, the two flexible sheets of the fluid passageway 44 close together to seal the filling tube 46. The filling tube 46 also has a second end 50 extending outwardly from the bag opening 36 of the inflatable chamber. The second end 50 engages and extends through the aperture 26 within the container 12 for affixing the bag 28 to the container 12. The second end 50 must be sufficiently rigid, non-collapsible, and self-supporting to retain the filling tube 46 within the aperture 26. Specifically, the filling tube 46 comprises an elongated body portion in the shape of a cylinder and having an open bore 53 extending between the first 48 and second 50 ends of the filling tube 46. As one can appreciate, filling tube 46, the elongated body portion, and the second end 50 could be of any shape or size so long as a sufficient rigidity is maintained and a bore extends therethrough.

The filling valve 38 also includes a retaining means 54 for securing the filling valve 38 within the aperture 26 in the container 12. More specifically, the body portion of the semi-rigid second end 50 supports the retaining means 54 for retaining the filling tube 46 in the aperture 26 in the container 12. Specifically, the retaining means 54 engages an outside surface of one of the walls 16 which secures the filling tube 46 within the aperture 26. The filling tube 46 and the sealing port 40 in the preferred embodiment are formed of a low density polyethylene (LDPE). The flexible bag 28 is formed of a metallocene-based LDPE in the preferred embodiment. However, as one can appreciate, the filling tube 46, sealing port 40, and bag 28 could be formed of any suitable material.

The retaining means 54 comprises an annular flange 54 extending outwardly from the second end 50 of the filling tube 46 wherein the flange 54 engages the outside surface of the container 12 to secure the filling tube 46 within the aperture 26. More specifically, the annular flange 54 engages the outside surface of one of the walls 16. As appreciated by those skilled in the art, the retaining means 54 may be of any design or configuration so long as the filling tube 46 is adequately secured within the aperture 26. Examples of different designs may include a plurality of splines extending radially from a hollow cylinder, a flange that extends only partially from a hollow cylinder, a plurality of snap tabs, a threaded end with or without a corresponding bolt, a spliced cylinder with projecting fingers, or simply an enlarged end that is press-fit into the aperture. Some alternative embodiments of how the retaining means 54 may be designed are illustrated in FIGS. 13 through 16 and discussed hereinbelow.

Generally, during installation of the filling valve 38, the second end 50 of the filling tube 46 is inserted through the aperture 26 in the container 12 and removably secured to one of the walls 16. The bag 28 is positioned in the container 12 adjacent the packaging item 20 and is inflated by the fluid medium, such as ambient air, received through the filling valve 38 in the aperture 26 of the upstanding wall 16, which compresses any void space between the packaging item 20 and the container 12. The inflated bag 28 abuts an interior surface of the walls 16 and the flaps 24 when the bag 28 is inflated.

The method of forming the inflatable packaging assembly 10 generally comprises the following steps: providing a container 12 having a base 14 and a plurality of upstanding walls 16 extending to a container opening 18; placing at least one packaging item 20 within the container 12; providing a flexible bag 28 defining an inflatable chamber with a bag opening 36 and a filling valve 38 having a first portion 37 fixedly secured to the bag opening 36 and a second portion 39 extending from the bag opening 36; inserting the second portion 39 of the filling valve 38 through an aperture 26 in the container 12; securing the second portion 39 of the filling valve 38 to the aperture 26 in the container 12 to resist displacement of the filling valve 38 from the aperture 26; placing the flexible bag 28 adjacent the packaging item 20; closing the container opening 18 of the container 12 over the bag 28 and packaging item 20; inflating the bag 28 with a fluid medium injected through the fixed filling valve 38 in the aperture 26 of the container 12 to compress any void space between the packaging item 20 and the container 12.

The closing of the container 12 is accomplished by folding the plurality of foldable flaps 24 over the container opening 18 to close and sealing the container 12. An injection hose 56 is inserted into the second portion 39 of the filling valve 38 and the fluid medium, such as ambient air, is injected through the hose 56, the filling valve 38, and into the chamber of the bag 28. The injection hose 56 may be any device which is capable of dispensing the fluid medium into the chamber of the bag 28. The inflating and expanding of the bag 28, via the fluid medium, continues until the bag 28 abuts the interior surface of the container 12. More specifically, the bag 28 abuts the interior surface of a number of walls 16 and the flaps 24. There must also be sufficient pressure created within the inflatable chamber to automatically close passageway 44 upon ceasing to introduce the fluid medium. The sealing port 40 can automatically seal the chamber once this sufficient pressure is created within the chamber.

Figure 8B:
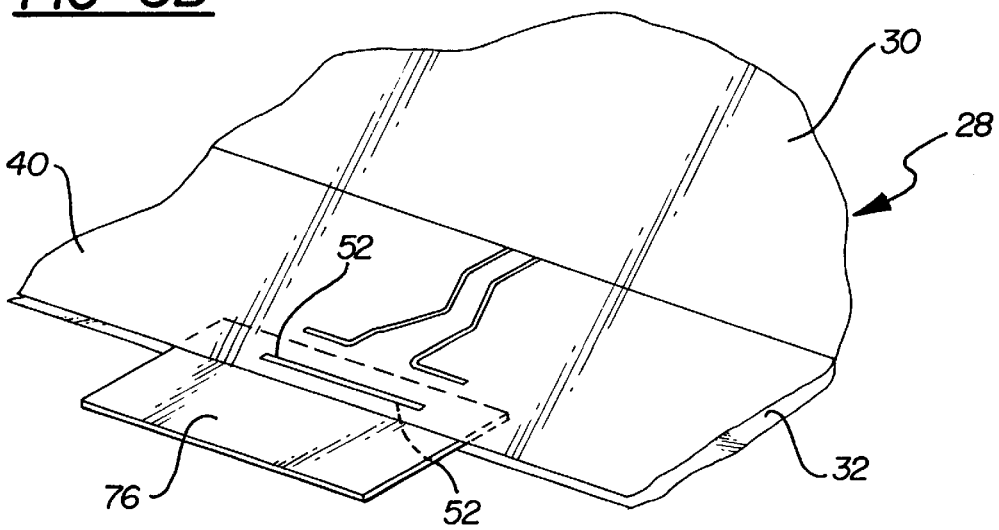
FIG. 8B is an enlarged fragmentary view of a particular step in the manufacturing sequence of the subject invention.
Figure 8A:
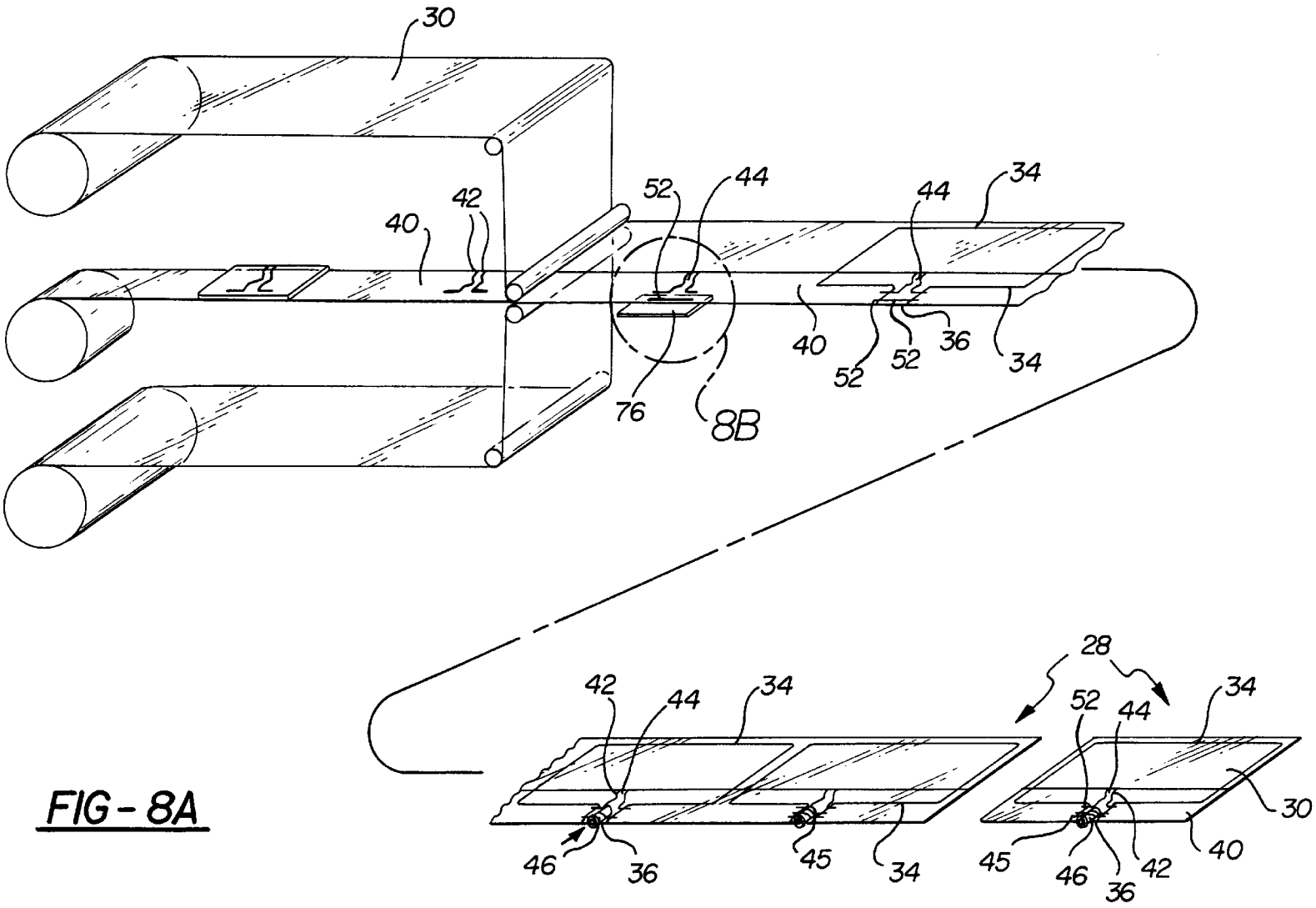
FIG. 8A is a perspective view showing the sequences of manufacturing the subject invention.

FIG. 8A discloses the sequences of manufacturing the flexible bag 28 of the preferred embodiment. FIG. 8B is an enlarged view of a particular step in the manufacturing sequence. The flexible bag 28 is fabricated from first 30 and second 32 bag panels, a flexible sealing port 40 having two flexible sheets, and a semi-rigid filling tube 46.

Specifically, the method of manufacture comprises the steps of; adhering the first 30 and second 32 bag panels and the two flexible sheets of the flexible sealing port 40 together to form a peripheral edge 34 and to create an inflatable chamber between the first 30 and second 32 bag panels; adhering the two flexible sheets of the flexible sealing port 40 together along a pair of seams 42 to form a fluid passageway 44 extending into the inflatable chamber; adhering the first bag panel 30 to one of the flexible sheets of the flexible sealing port 40 along a first port seal 52 and adhering the second bag panel 32 to the other flexible sheet of the flexible sealing port 40 along a second port seal 52 to form a bag opening 36 in close proximity to the fluid passageway 44; inserting the semi-rigid filling tube 46 within the bag opening 36 to interconnect the bag opening 36 with the fluid passageway 44 and the inflatable chamber; and adhering the first 30 and second 32 bag panels and the two flexible sheets of the flexible sealing port 40 to the semi-rigid filling tube 46 along a tube seal 45 to ensure that any fluid passing into the inflatable chamber passes through the filling tube 46 and the fluid passageway 44.

The adhered flexible sheets of the sealing port 40 are inserted between the first 30 and second 32 bag panels before the first and second port seals 52 are formed. As best shown in FIG. 8B, the forming of the first and second port seals 52 is further defined by inserting a non-adhereable plate 76 between the two flexible sheets of the flexible sealing port 40 to ensure the first port seal 52 adheres only along the first bag panel 30 and the second port seal 52 adheres only along the second bag panel 32.

The forming of the fluid passageway 44 is further defined by adhering the two flexible sheets of the flexible sealing port 40 together along spaced apart parallel seams 42. As discussed in detail above, the preferred embodiment of the parallel seams 42 is a S-shaped or curved seam 42. However, the parallel seams 42 may be of any number of designs so long as the inflatable chamber can be adequately sealed. The fluid passageway 44 is even further defined by the spaces apart parallel seams 42 extending transversely from the peripheral edge 34. More specifically, in the preferred embodiment, the seams 42 extend substantially perpendicular from the peripheral edge 34 of the flexible bag 28.

The forming of the peripheral edge 34 is further defined by creating a substantially rectangular shaped flexible bag 28 defining a substantially rectangular shaped inflatable chamber. As discussed above the purpose for having a rectangular shaped bag 28 is simply to conform to the rectangular shaped container 12 disclosed. Also discussed above, the flexible bag 28 could be of any desired shape wherein the forming of the peripheral edge 34 would outline the desired shape to form the inflatable chamber.

The final step in the manufacturing process includes cutting through the first 30 and second 32 bag panels and the two flexible sheets of the flexible sealing port 40 near the peripheral edge 34 to detach the substantially rectangular shaped flexible bag 28.

The preferred order of operation with regards to the preferred method of manufacture comprises the steps of; adhering the two flexible sheets of the flexible sealing port 40 together in the desired configuration to form seams 42 and the fluid passageway 44; inserting the adhered flexible sheets of the sealing port 40 between the first 30 and second 32 bag panels; adhering the first bag panel 30 to one of the flexible sheets of the flexible sealing port 40 along a first port seal 52 and adhering the second bag panel 32 to the other flexible sheet of the flexible sealing port 40 along the second port seal 52; adhering the first 30 and second 32 bag panels and the two flexible sheets of the flexible sealing port 40 together to form the peripheral edge 34 and the bag opening 36, and creating the inflatable chamber between the first 30 and second 32 bag panels; inserting the semi-rigid filling tube 46 within the bag opening 36 to interconnect the bag opening 36 with the fluid passageway 44 and the inflatable chamber; adhering the first 30 and second 32 bag panels and the two flexible sheets of the flexible sealing port 40 to the semi-rigid filling tube 46 along the tube seal 45; and finally cutting through the first 30 and second 32 bag panels and the two flexible sheets of the flexible sealing port 40 to detach the flexible bag 28.

Figure 9:
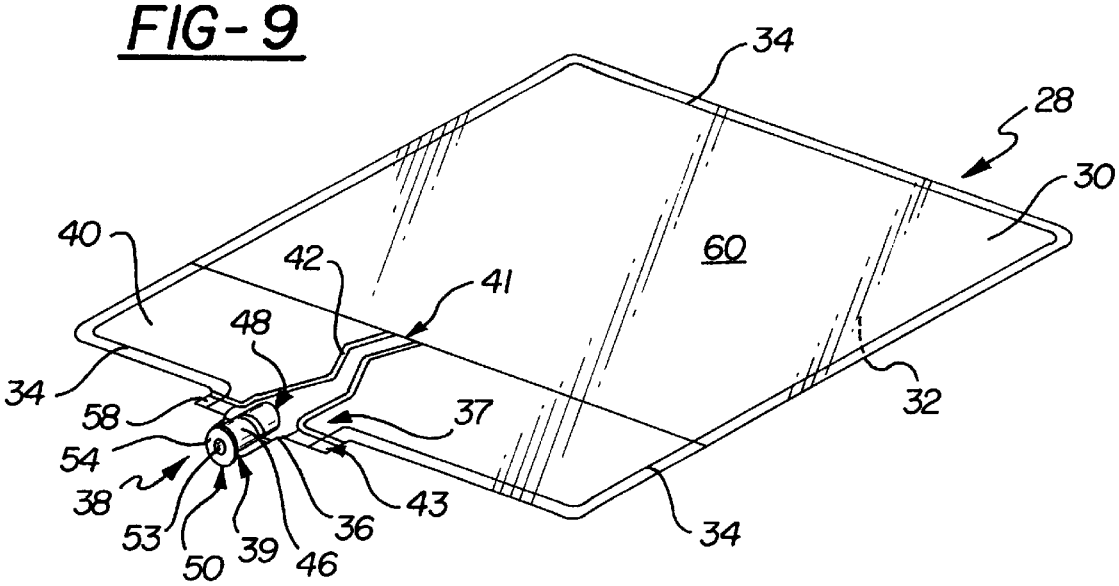
FIG. 9 is a perspective view of an alternative embodiment of the subject invention.

FIG. 9 discloses an alternative embodiment of the subject invention wherein like numerals indicate like or corresponding parts. The flexible bag 28 has first 30 and second 32 bag panels formed with a neck portion 58 extending outwardly from a main rectangular portion 60. The peripheral edges 34 of the bag panels 30, 32 are sealed to define the inflatable chamber therebetween. The peripheral edges 34 extend along the rectangular portion 60 and terminate at the neck portion 58 to form the bag opening 36. This embodiment also discloses the filling valve 38 comprising the flexible sealing port 40 and the semi-rigid filling tube 46. The first end 41 of the sealing port 40 extends into and is in fluid communication with the inflatable chamber which is also the rectangular portion 60. The second end 43 extends into the neck portion 58 of the bag 28. The first end 48 of the filling tube 46 is disposed within the neck portion 58 and extends at least partially into the bag opening 36. The remaining aspects of this alternative embodiment are substantially the same as the primary embodiment.

Figure 10:
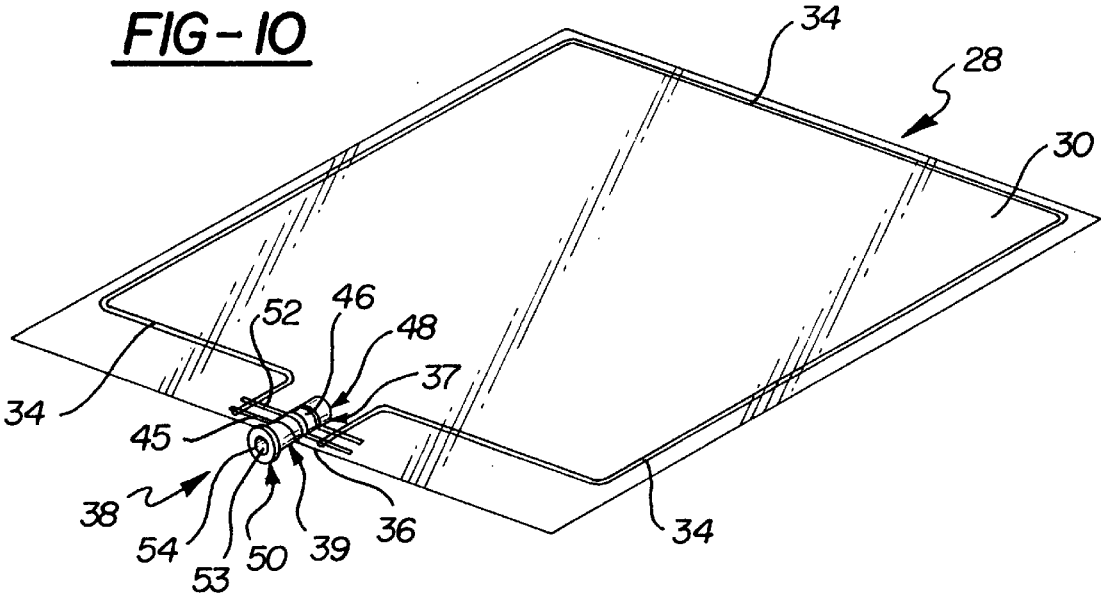
FIG. 10 is a perspective view of another alternative embodiment of the subject invention.

FIG. 10 discloses another alternative embodiment of the subject invention wherein like numerals indicate like or corresponding parts. The first portion 37 of the filling valve 38 corresponds to the first end 48 of the semi-rigid filling tube 46 and the second portion 39 of the filling valve 38 corresponds to the second end 50 of the semi-rigid filling tube 46. In other words, this alternative embodiment does not incorporate the use of a separate flexible sealing port. The first end 48 at least partially extends into the bag opening 36 and the second end 50 engages the aperture 26 within the container 12. As discussed above, the securing of the second end 50 into the aperture 26 is accomplished by the retaining means 54 wherein the preferred embodiment of the retaining means 54 comprises an annular flange 54 extending outwardly from the second end 50 of the filling tube 46. In addition, the second end 50 could include a cap or cork (not shown) for sealing the inflatable chamber or a sealing port could be disposed within the bore 53 of the filling tube 46.

Figure 11:
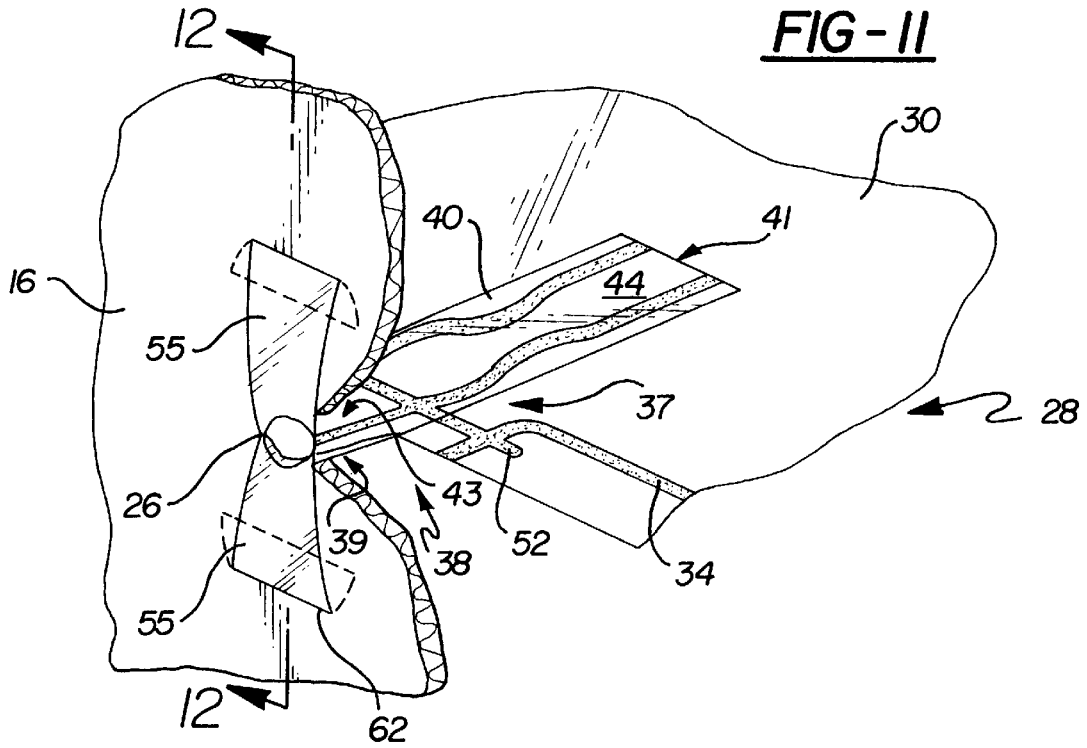
FIG. 11 is a fragmentary view of another alternative embodiment of the subject invention secured to the packaging container.
Figure 12:
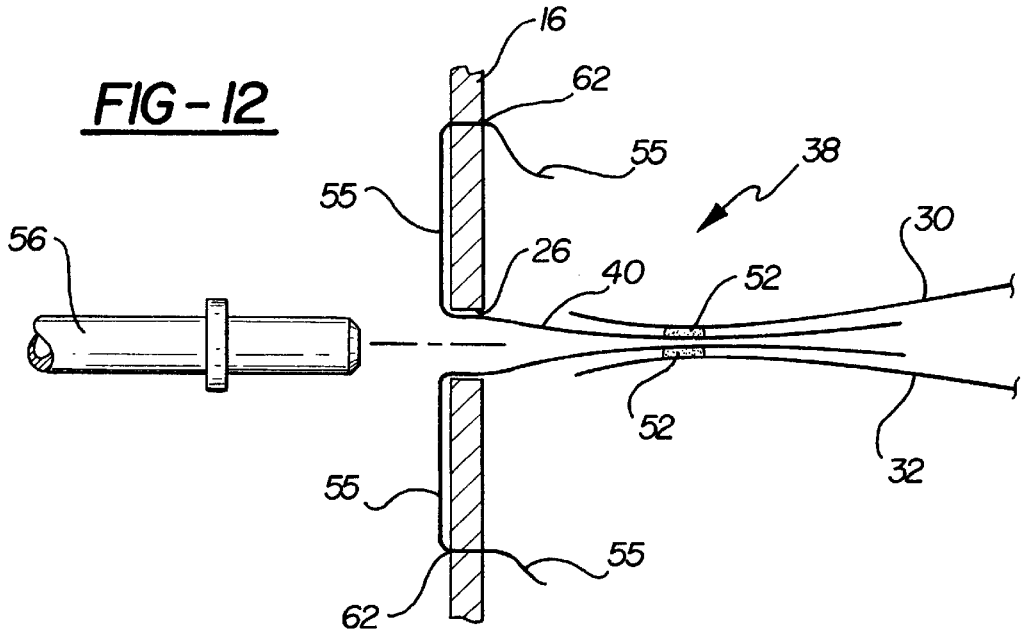
FIG. 12 is a cross-sectional view taken along line 12—12 of FIG. 11.

FIGS. 11 and 12 disclose another alternative embodiment of the subject invention wherein like numerals indicate like or corresponding parts. The first portion 37 of the filling valve 38 corresponds to the first end 41 of the sealing port 40 and the second portion 39 of the filling valve 38 corresponds to the second end 43 of the sealing port 40. In other words, this alternative embodiment does not incorporate the use of a separate semi-rigid filling tube. The first end 41 of the sealing port 40 extends into and is in fluid communication with the inflatable chamber. The sealing port 40 does not extend across the entire width of the bag 28 and the fluid passageway 44 has an hourglass figure. As discussed above, the specific configuration of the fluid passageway 44 is not critical to the overall scope of the subject invention. The second end 43 extends through and is removably secured to the aperture 26 within the container 12. At least one flange 55 extends outwardly from the second end 43 of the sealing port 40. Additional apertures or slits 62 are formed within the container 12 in close proximity to the aperture 26. More specifically, the aperture 26 and slits 62 are formed within one of the walls 16 in the container 12. The flanges 55 extend outwardly from the aperture 26, along the surface of the wall 16, and through the slits 62 back into the container 12, thereby securing the sealing port 40 within the aperture 26. Specifically, the flanges 55 are rectangular strips extending from the second end 43 of the sealing port 40, however, the flanges 55 may be of any suitable design or configuration so long as the second end 43 of the sealing port 40 is adequately retained within the aperture 26.

Figure 13:
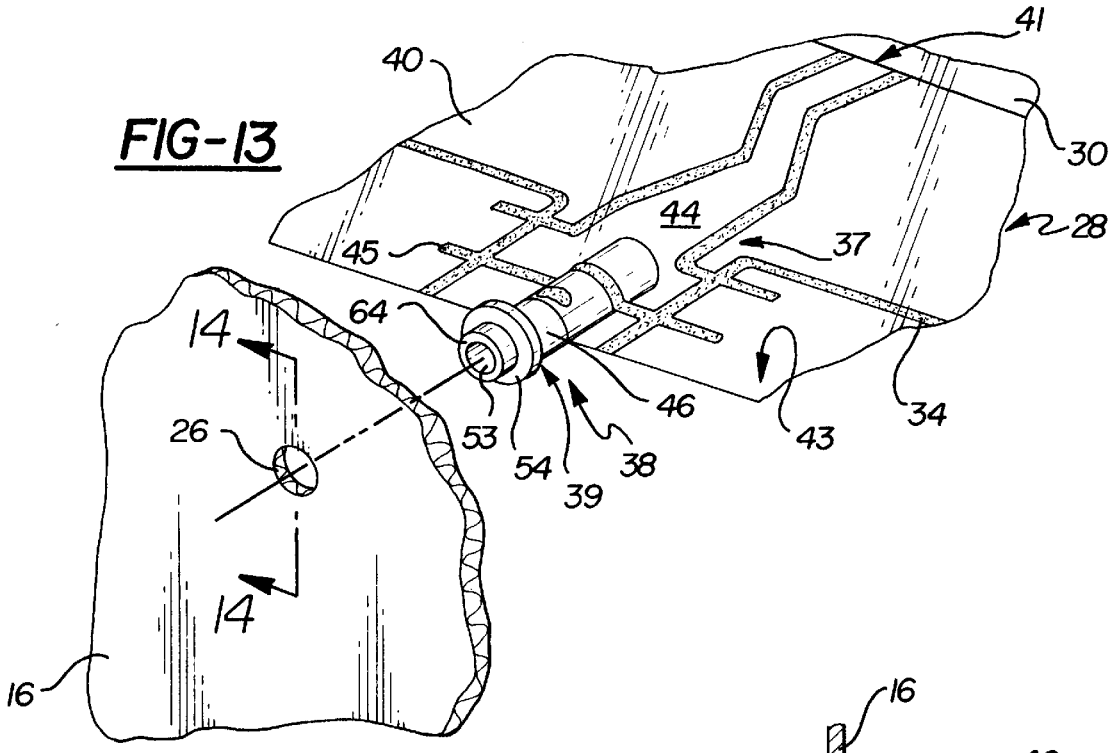
FIG. 13 is a fragmentary view of another alternative embodiment of the subject invention in exploded relationship to the packaging container.
Figure 14:
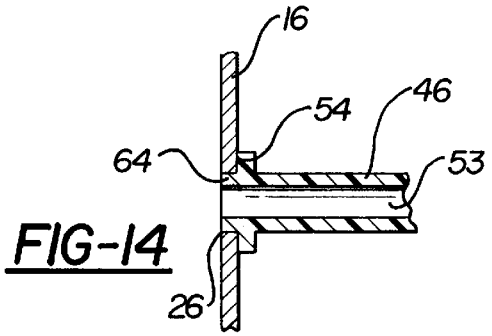
FIG. 14 is a cross-sectional view taken along line 14—14 of FIG. 13 with the alternative embodiment secured to the packaging container.

FIGS. 13 and 14 disclose another alternative embodiment of the subject invention wherein like numerals indicate like or corresponding parts. More specifically, this is an alternative embodiment of the retaining means 54 of the semi-rigid filling tube 46. In this embodiment, a cylindrical body 64 extends outwardly from the annular flange 54 to a distance equal to the thickness of the wall 16. The open bore 53 also extends through the cylindrical body 64. During installation of the bag 28, the cylindrical body 64 engages the aperture 26 and the flange 54 abuts an inside surface of the wall 16, thereby removably securing the filling tube 46 to the aperture 26. The size, shape and configuration of the body 64 may be different than shown in the Figures so long as the filling tube 46 is adequately retained within the aperture 26. The remaining aspects of this alternative embodiment are substantially the same as the primary embodiment.

Figure 15:
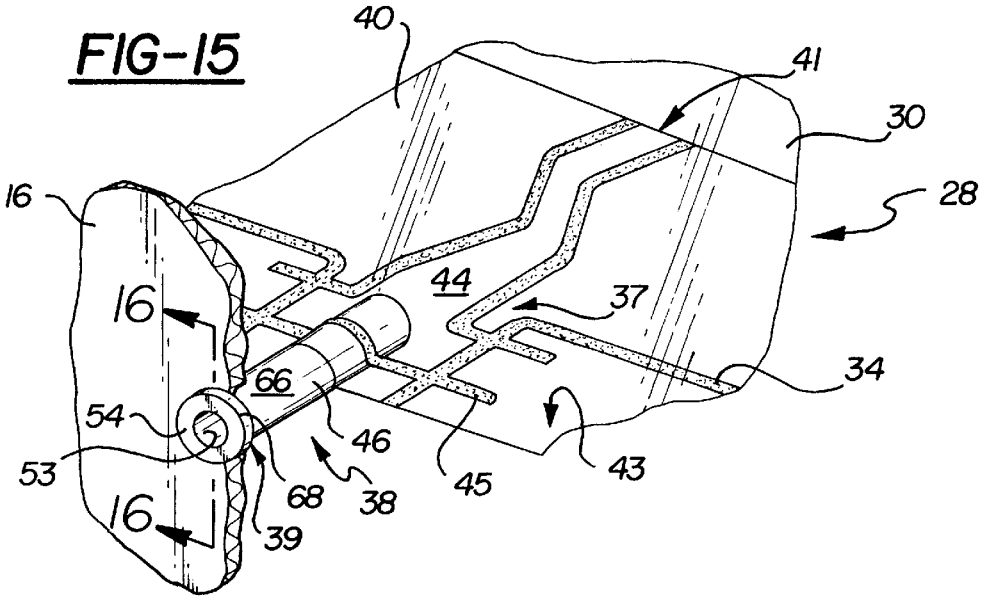
FIG. 15 is a fragmentary view of another alternative embodiment of the subject invention secured to the packaging container.
Figure 16:
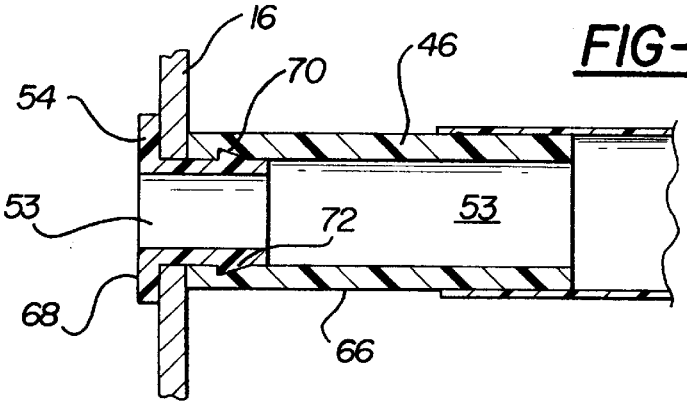
FIG. 16 is a cross-sectional view taken along line 16—16 of FIG. 15.

FIGS. 15 and 16 disclose another alternative embodiment of the subject invention wherein like numerals indicate like or corresponding parts. More specifically, this is another alternative embodiment of the retaining means 54 of the semi-rigid filling tube 46. In this embodiment, the filling tube 46 is broken into two separate parts 66, 68. The first part 66 includes the elongated body portion of the filling tube 46 with an internal groove 70 formed within the open bore 53. The second part 68 also includes an elongated body portion with the annular flange 54 and a retaining rib 72 extending outwardly therefrom. The open bore 53 also extends through the second part 68. During installation of the bag 28, the first part 66 abuts the inside surface of the wall 16 and the second part 68 is then pushed through the aperture 26 from outside the wall 16. The body portion of the second part 68 extends into the bore 53 of the first part 66 until the retaining rib 72 engages the internal groove 70 which locks the two parts 66, 68 together. When the two parts 66, 68 are locked together, the annular flange 54 abuts the exterior surface of the wall 16, thereby removably securing the filling tube 46 within the aperture 26. The remaining aspects of this alternative embodiment are substantially the same as the preferred embodiment.

Figure 17:
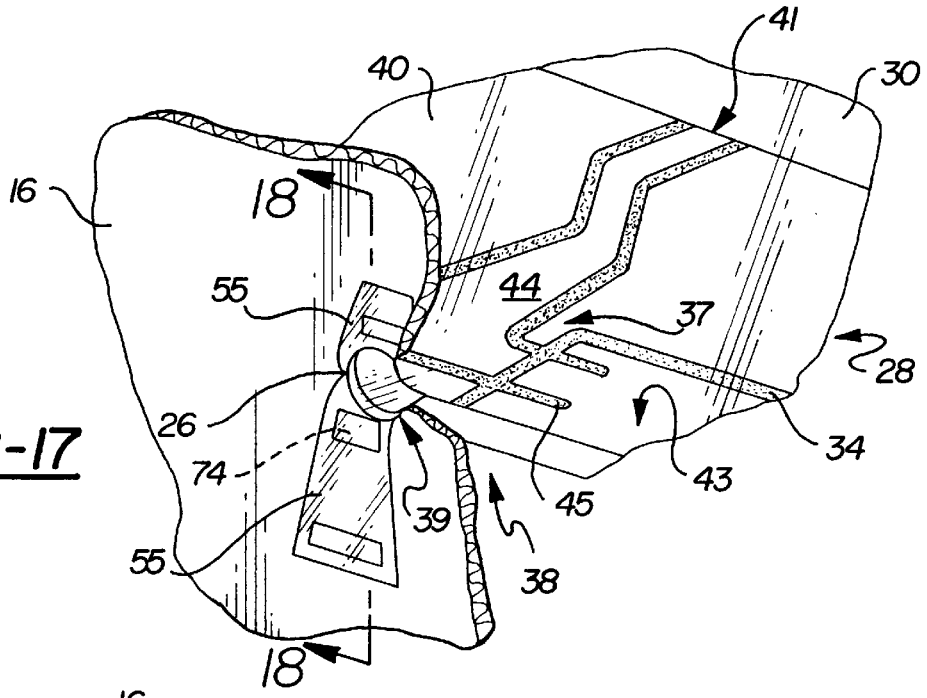
FIG. 17 is a fragmentary view of another alternative embodiment of the subject invention secured to the packaging container.
Figure 18:
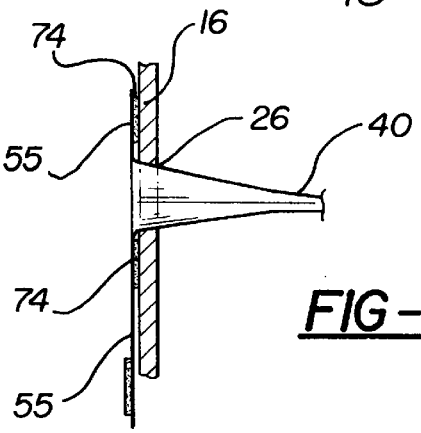
FIG. 18 is a cross-sectional view taken along line 18—18 of FIG. 17.

FIGS. 17 and 18 disclose another alternative embodiment of the subject invention wherein like numerals indicate like or corresponding parts. The first portion 37 of the filling valve 38 corresponds to the first end 41 of the sealing port 40 and the second portion 39 of the filling valve 38 corresponds to the second end 43 of the sealing port 40. This alternative embodiment is similar to the alternative embodiment disclosed in FIGS. 11 and 12, i.e., the use of a separate semi-rigid filling tube is not incorporated. The first end 41 of the sealing port 40 extends into and is in fluid communication with the inflatable chamber. The second end 43 extends into and is removably secured to the aperture 26 within one of the walls 16 of the container 12. At least one flange 55 extends outwardly from the second end 43 of the sealing port 40. An adhesive 74 is affixed to each flange 55 on one surface thereof. The adhesive 74 may be a glue, a hook and loop fastener, or some other appropriate device without deviating from the scope of the subject invention. The flanges 55 extend outwardly from the aperture 26 and are pressed against the exterior surface of the wall 16 which engages the adhesive 74 with the wall 16 and adheres the flange 55 to the wall 16, which in turn secures the sealing port 40 within the aperture 26. The flanges 55 are rectangular strips extending from the second end 43 of the sealing port 40, however, the flanges 55 may be of any suitable design or configuration so long as the second end 43 is adequately retained within the aperture 26. In addition, one of the flanges 55 may be long enough to fold the flange 55 over the aperture 26 to cover the aperture 26.

Figure 19:
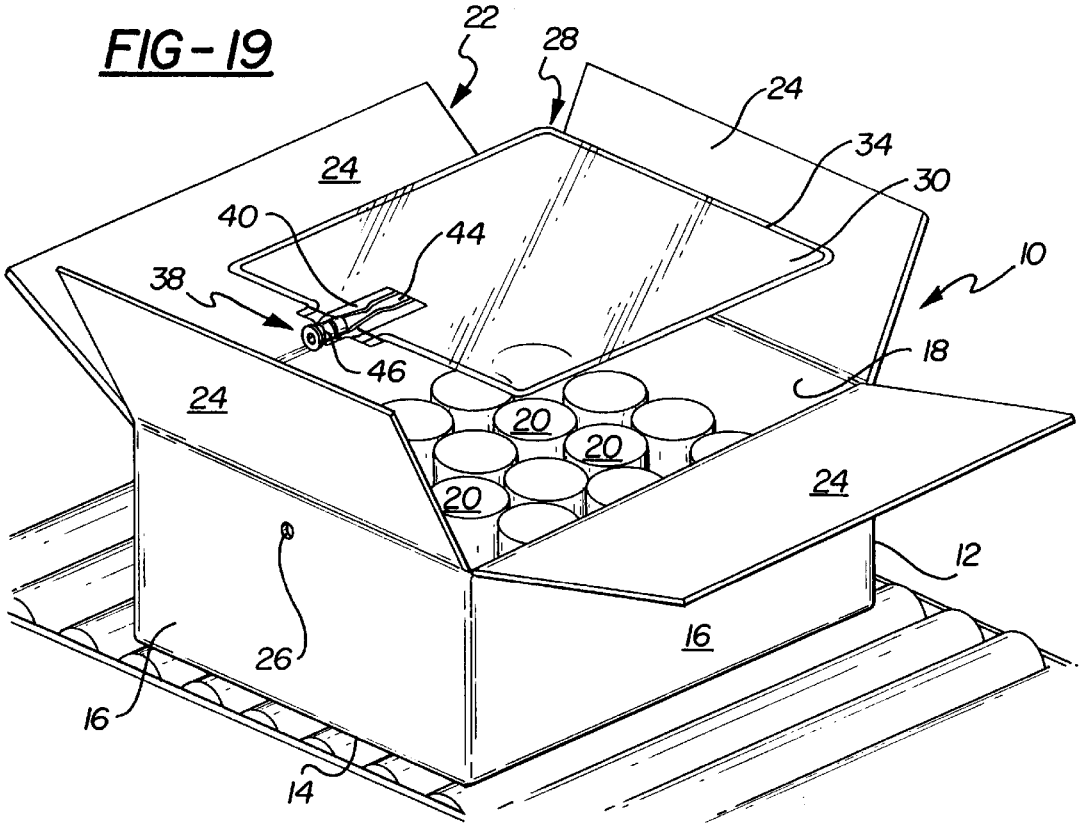
FIG. 19 is a perspective view of yet another alternative embodiment of the subject invention in exploded relationship to the open packaging container.

FIG. 19 discloses yet another alternative embodiment of the subject invention wherein like numerals indicate like or corresponding parts. The filling valve 38 comprises the flexible sealing port 40 and the semi-rigid filling tube 46 as disclosed in the preferred embodiment. This alternative embodiment is similar to the alternative embodiment disclosed in FIG. 9, i.e., the flexible bag 28 has a neck portion 58 extending outwardly from a main rectangular portion 60. However, the flexible sealing port 40 does not extend across the entire width of the bag 28 and the fluid passageway 44 has an hourglass figure.

Figure 20B:
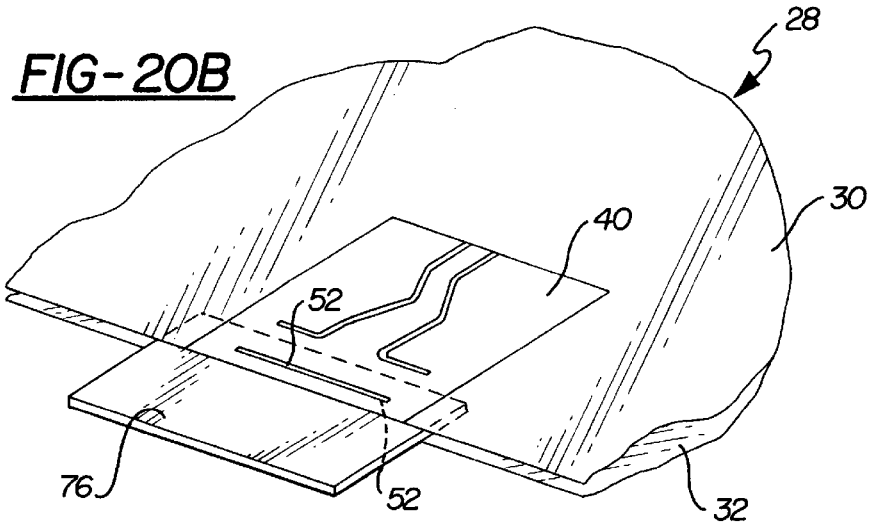
FIG. 20B is an enlarged fragmentary view of a particular step in the manufacturing sequence of the alternative embodiment of the subject invention.
Figure 20A:
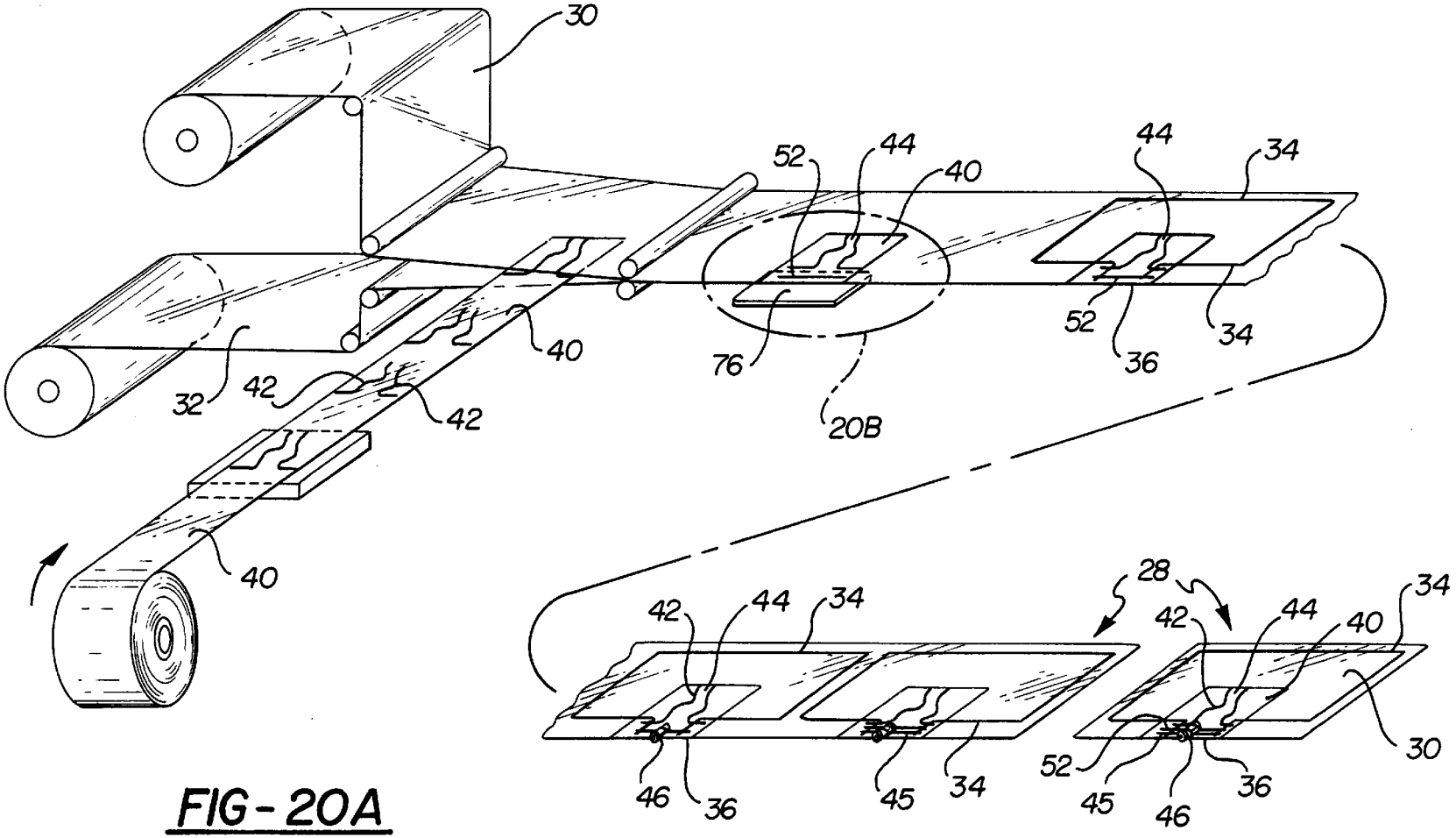
FIG. 20A is a perspective view showing the sequences of manufacturing an alternative embodiment of the subject invention.

FIG. 20A discloses the sequences of manufacturing an alternative embodiment of the flexible bag 28. FIG. 20B is an enlarged view of a particular step in the manufacturing sequence. As in the preferred embodiment, the flexible bag 28 is fabricated from first 30 and second 32 bag panels, the flexible sealing port 40 having two flexible sheets, and the semi-rigid filling tube 46.

The preferred order of operation with regards to this alternative method of manufacture comprises the steps of; adhering the two flexible sheets of the flexible sealing port 40 together in the desired configuration to form seams 42 and the fluid passageway 44; inserting the adhered flexible sheets of the sealing port 40 between the first 30 and second 32 bag panels; cutting through the adhered flexible sheets of the sealing port 40 to detach the adhered flexible sheets of the sealing port 40; adhering the first bag panel 30 to one of the flexible sheets of the flexible sealing port 40 along a first port seal 52 and adhering the second bag panel 32 to the other flexible sheet of the flexible sealing port 40 along the second port seal 52; adhering the first 30 and second 32 bag panels and the two flexible sheets of the flexible sealing port 40 together to form the peripheral edge 34 and the bag opening 36, and creating the inflatable chamber between the first 30 and second 32 bag panels; inserting the semi-rigid filling tube 46 within the bag opening 36 to interconnect the bag opening 36 with the fluid passageway 44 and the inflatable chamber; adhering the first 30 and second 32 bag panels and the two flexible sheets of the flexible sealing port 40 to the semi-rigid filling tube 46 along the tube seal 45; and finally cutting through the first 30 and second 32 bag panels and the two flexible sheets of the flexible sealing port 40 to detach the flexible bag 28.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An inflatable packaging assembly (10) comprising:

a container (12) having a base (14) and a plurality of upstanding walls (16) extending from said base (14) to a container opening (18) for receiving and storing a package item (20) therein;

an aperture (26) passing through a portion of said container (12);

a flexible bag (28) defining an inflatable chamber having a bag opening (36) for receiving a fluid medium to inflate said bag (28);

a filling valve (38) having a first portion (37) fixedly secured to said bag opening (36) and in fluid communication with said inflatable chamber of said bag (28) and having a second portion (39) inserted through said aperture (26) in said container (12), said bag (28) is positioned in said container (12) adjacent the packaging item (20) and inflatable by said fluid medium received through said filling valve (38) in said aperture (26) of said container (12);

said filling valve (38) includes a semi-rigid filling tube (46) having an elongated body portion extending between first (48) and second (50) ends, said first end (48) in fluid communication with said inflatable chamber of said bag (28) and said second end (50) extending through said aperture (26) in said container (12);

said assembly characterized by said filling valve (38) including a retaining means (54) for securing said filling valve (38) within said aperture (26), said retaining means (54) comprising an annular flange (54) extending outwardly from said second end (50) of said filling tube (46) and engaging an outside surface of said container (12) to secure said filling tube (46) within said aperture (26).

2. An assembly as set forth in claim 1 wherein said elongated body portion of said filling tube (46) is in the shape of a cylinder and has a bore (53) extending between said first (48) and second (50) ends of said filling tube (46).

3. An assembly as set forth in claim 1 wherein said aperture (26) passes through one of said upstanding walls (16) with said annular flange (54) engaging an outside surface of said wall (16) to secure said filling tube (46) within said aperture (26).

4. An assembly as set forth in claim 1 wherein said filling valve (38) further includes a flexible sealing port (40) having a first end (41) in fluid communication with said inflatable chamber and a second end (43) secured to said filling tube (46), said sealing port (40) extending into said chamber for automatically sealing said filling tube (46) in response to a predetermined pressure within said chamber.

5. An assembly as set forth in claim 4 wherein said sealing port (40) comprises two flexible sheets adhered together by a seam (42).

6. An assembly as set forth in claim 5 wherein said seam (42) defines a fluid passageway (44) extending between said first end (48) of said filling tube (46) and said inflatable chamber of said bag (28).

7. An assembly as set forth in claim 6 wherein said bag (28) comprises first (30) and second (32) bag panels having peripheral edges (34) sealed together to define said inflatable chamber.

8. An assembly as set forth in claim 7 including a first port seal (52) to adhere said first bag panel (30) to one of said flexible sheets of said sealing port (40) and a second port seal (52) to adhere said second bag panel (32) to the other of said flexible sheet of said sealing port (40).

9. An assembly as set forth in claim 8 including a tube seal (45) to secure said filling tube (46) to said sealing port (40) and said first (30) and second (32) bag panels.

10. An assembly as set forth in claim 9 including a covering means (22) for covering said container opening (18) and closing said container (12).

11. An assembly as set forth in claim 10 wherein said covering means (22) includes a plurality of flaps (24) extending from said upstanding walls (16) of said container (12) for folding over said container opening (18) to close said container (12).

12. An assembly as set forth in claim 11 wherein said bag (28) abuts an interior surface of said walls (16) and said flaps (24) when said bag (28) is inflated.

13. An inflatable packaging assembly (10) comprising:

a container (12) having a base (14) and a plurality of upstanding walls (16) extending from said base (14) to a container opening (18) for receiving and storing a package item (20) therein;

an aperture (26) passing through a portion of said container (12);

a flexible bag (28) defining an inflatable chamber having a bag opening (36) for receiving a fluid medium to inflate said bag (28);

a filling valve (38) having a first portion (37) fixedly secured to said bag opening (36) and in fluid communication with said inflatable chamber of said bag (28) and having a second portion (39) inserted through said aperture (26) in said container (12), said bag (28) is positioned in said container (12) adjacent the packaging item (20) and inflatable by said fluid medium received through said filling valve (38) in said aperture (26) of said container (12);

said filling valve (38) including a flexible sealing port (40) having a first end (41) in fluid communication with said inflatable chamber and a second end (43) extending through said aperture (26) in said container (12);

said assembly characterized by said filling valve (38) including a retaining means (54) for securing said filling valve (38) within said aperture (26), said retaining means (54) comprising at least one flange (55) extending outwardly from said second end (43) of said sealing port (40) and engaging an outside surface of said container (12) to secure said sealing port (40) within said aperture (26).

14. An assembly as set forth in claim 13 wherein said sealing port (40) comprises two flexible sheets adhered together by a seam (42).

15. An assembly as set forth in claim 14 wherein said seam (42) defines a fluid passageway (44) extending between said first end (48) of said filling tube (46) and said inflatable chamber of said bag (28).

16. An assembly as set forth in claim 15 wherein said bag (28) comprises first (30) and second (32) bag panels having peripheral edges (34) sealed together to define said inflatable chamber.

* * * * *